United States Patent [19]

Baer

[11] Patent Number: 4,637,631

[45] Date of Patent: Jan. 20, 1987

[54] COMBINED BOOK AND MIRROR

[75] Inventor: Robert J. Baer, Honolulu, Hi.

[73] Assignee: RJB and C Company, Honolulu, Hi.

[21] Appl. No.: 664,021

[22] Filed: Oct. 23, 1984

[51] Int. Cl.[4] ..... B42D 5/00; B42D 15/00; B42F 3/00

[52] U.S. Cl. ..... 281/15 R; 281/22; 281/3 R

[58] Field of Search ..... 281/3 R, 15 R, 22, 45, 281/3; 282/8 R, 22 R; 446/147; 350/600

[56] References Cited

U.S. PATENT DOCUMENTS

| | | | |
|---|---|---|---|
| D. 19,527 | 12/1889 | Petri | 281/22 X |
| 407,074 | 7/1889 | Jaeger | 281/22 X |
| 683,853 | 10/1901 | Forber | 281/22 |
| 809,698 | 1/1906 | Kelley | 350/600 |
| 2,487,240 | 11/1949 | Meyer | 446/147 |
| 3,583,729 | 6/1971 | DeGroot | 281/3 |
| 4,140,565 | 2/1979 | Parker et al. | 281/22 |

*Primary Examiner*—Paul A. Bell
*Assistant Examiner*—Paul M. Heyrana, Sr.
*Attorney, Agent, or Firm*—James C. Wray

[57] ABSTRACT

A book in combination with a mirror is disclosed. A book such as one might ordinarily keep on one's shelf has a mirror embedded in one of the bound sections such that upon picking up the book and leafing through several pages, one is confronted with one's reflection. This allows for an added dimension to communication. The mirror is embedded in a thick section, the leaves of which may be bound and laminated together, a hole corresponding in dimensions to the mirror is cut partially therethrough, a mirror is immovably placed in said hole.

10 Claims, 3 Drawing Figures

COMBINED BOOK AND MIRROR

BACKGROUND OF THE INVENTION (1) Field of the Invention

This invention pertains to books and book binding, and more particularly to modifications of books wherein a device is combined with the book preferably the combination is such that the device is embedded.

(2)

The art in this area shows books in various combinations with devices. Situations may arise where it is desirable that some device or apparatus be inserted within a book. U.S. Pat. No. 2,473,938 discloses a combined photograph album and music box. U.S. Pat. No. 170,042 discloses a photograph album which has been modified such that articles may be inserted into the book.

SUMMARY OF THE INVENTION

It is an object of the invention to provide a novel book which contains a mirror embedded within such that on reading the book one would come across a rather thick page wherein is embedded a mirror reflecting the readers face.

It is another object of this invention to provide a promotional device.

It is a further object of this invention to provide means for conveying nonverbal communication within a verbal communication media.

The invention includes a mirror embedded within a book. In the construction of the book, a series of sections in laminar alignment are bound to the spine of a cover. Each of these sections is provided with a plurality of flat rectangular sheets also in laminar alignment and these sheets are connected or bound on one of their lateral edges such that each section contains leaves bound together upon one edge. This one edge forms the bound edge which is connected to the spine of the cover. One of these sections, however, has been laminated together and a thick flexible leaf is formed. A hole has been cut into this thick flexible leaf where said hole extends partially through this thick flexible leaf. A mirror has been immovably attached within said hole such that the mirror is inset within the flexible leaf and the surface of the mirror is even with the surface of the thick flexible leaf. This book in combination with a mirror has a cover which may be of a typical cover design containing a front and back connected together by a spine.

Preferably, the leaves of each section are made of paper. The hole cut within the thick flexible leaf should be made such that it conforms to the dimensions of the mirror. A preferable shape to the hole would be rectangular. The mirror may be any flat device imparting a reflection. The cover of the book may be inflexible or flexible and may be made of any suitable material. The section of the book wherein the mirror is embedded does not have to be flexible. It may be inflexible.

DESCRIPTION OF THE PREFERRED EMBODIMENT

Figure 1:
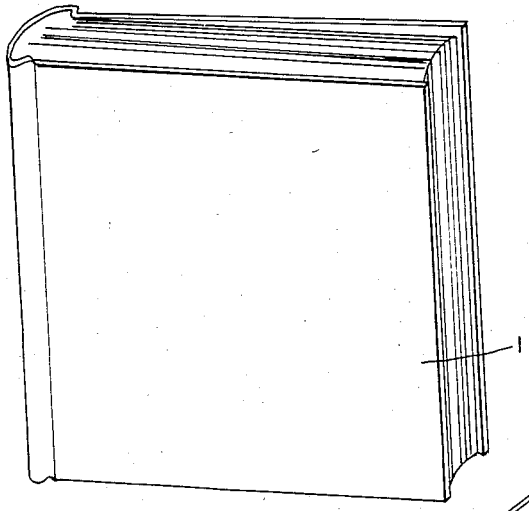
FIG. 1 is a front elevational view of a typical book.
Figure 2:
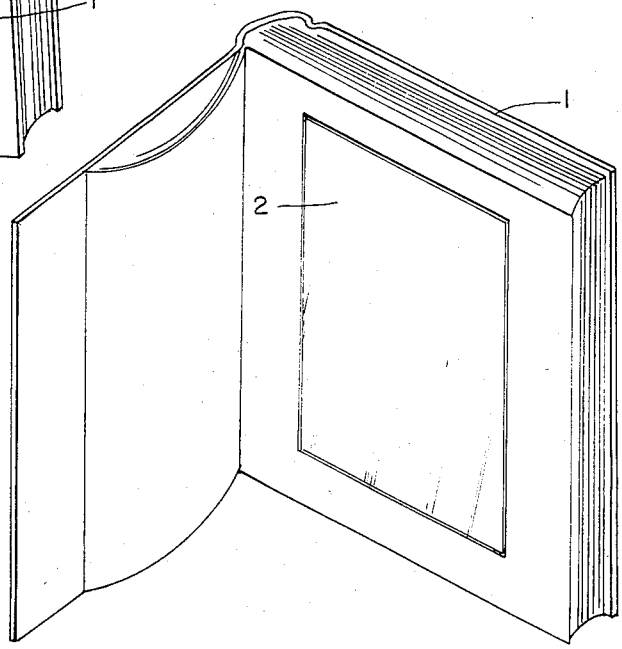
FIG. 2 is a front elevational view of the open book of FIG. 1 showing the mirror.
Figure 3:
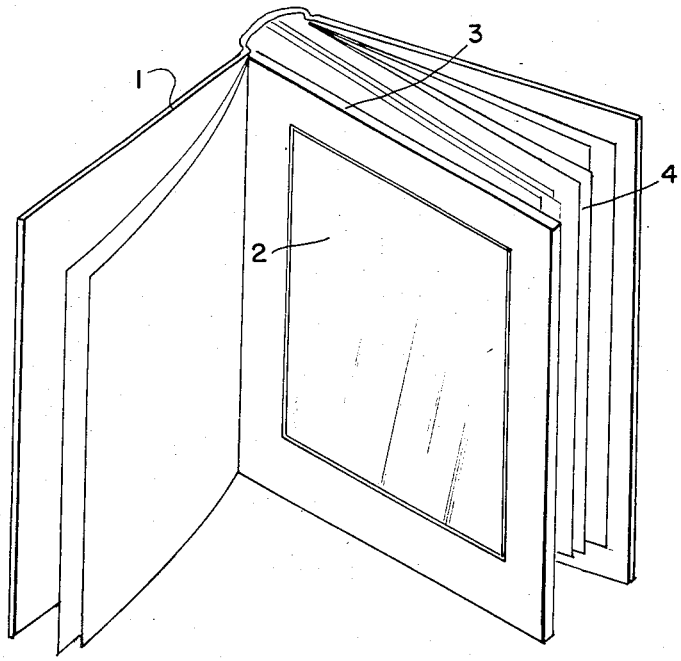
FIG. 3 is a front elevational view of the open book in FIG. 2 showing the section containing the mirror in relation to the other sections and leaves thereof.

The invention as shown in the closed position in FIG. 1 is a fairly typical appearing book. It should be noted that FIG. 1 depicts a hardbound book, but the invention contemplates a softbound book as well. Upon opening the book and leafing through several pages, the reader is confronted with their reflection in the embedded mirror 2 embedded within a thick section 3 (See FIG. 3). Referring to FIG. 3, one may readily see that the mirror 2 is embedded in a thick section 3 which is thick in relation to the normal leaves of the book as represented by the numeral 4.

The book in combination with a mirror may be constructed in any suitable book binding method. It is preferred that the book be constructed from the beginning with the idea that the mirror will be placed within. Therefore, in the binding of the book, a series of sections are bound to a cover. Each of these sections contains leaves which form the pages of the book. Initially these leaves are nothing more than flat rectangular sheets in laminar alignment. The sheets are connected to each other on one of their lateral edges such that the section is formed containing leaves bound together on one edge with that edge being the bound edge. These sections are then bound together by connecting each section to a spine of a cover. The ways for binding leaves within a section and a section within a spine are manifold. For example, glue may be used, thread in combination with glue, and rods held on the back of each section with transverse strips connected to the rod, thread connecting the transverse strips and rods together with thread connecting the rods of each section together and glue and/or thread connecting the sections to the spine of the book. The ways of connecting these sections to a cover and sections to themselves, and leaves within the sections may be performed by any suitable manner.

When gathering the sections together for binding, at least one of the sections should be laminated together to form a thick section. This thick section then is to have a hole routed within where the hole would extend partially therethrough. This hole would conform to the shape of the mirror. The mirror may be round, eliptical, square or rectangular in shape. The mirror may be attached to the hole before binding or after binding, which ever is easier. An alternative method for preparing a leaf which would contain the mirror would be to use a suitably thick planar member which would not need to be laminated and could be bound together with the other sections forming the book. This section may be of any suitable material flexible or inflexible, paper, cloth, or polymeric.

It should be noted that the book in combination with a mirror may be a hardback book or a paperback book. The technology in making the paperback book may be somewhat different than the technology of constructing a hardbound book described above.

The paperback model of the book in combination with the mirror is essentially the same as the hardback model with a few simple variations. The paperback book again would be constructed of sections containing leaves. The sections being stacked one on top of the other in laminar alignment and the sections being bound on their bound edge to a paperback cover spine. Again, the sections should contain at least one section which has been laminated together to form a thick section where a hole may be cut partially therethrough such that a mirror may be mounted within. It should be understood that the lamination of the sections may also be done after the book has been bound. It should also be understood that in the paperback example, one of the sections may also be a nonlaminated thick section which may be flexible or inflexible and which would be sufficiently thick such that a hole may be cut partially therethrough and a mirror embedded therein.

The book in combination with a mirror is a commercially attractive device. It may be used in promotional situations such as the cosmetic industry would require. Basically the device may be used in any situation where an author of a book would want to direct attention to the reader for some reason by confronting the reader with the reader's own reflection. This combination of nonverbal communication coupled with the verbal communication within the book may amount to a very powerful communication. The mirror, it has been found, greatly enhances the communicability of the book when the verbal message of the book is structured in such a way as to include the mirror in the sequence of the message conveyed.

Having described the invention with particularity and disclosing how to make and use the invention, what I claim is:

1. A book in combination with a mirror, comprising:

(a) a series of sections in laminar alignment, wherein each section is provided with a plurality of flat rectangular sheets in laminar alignment, wherein each sheet is provided with first and second lateral edges, whereby each section contains leaves bound together on one edge, and whereby said one edge is the bound edge, and wherein at least one section is laminated together by means for laminating, whereby a thick, flexible leaf is formed;

(b) a hole in said thick leaf extending partially therethrough;

(c) a mirror immovably placed in said hole by means for attaching;

(d) a cover for said series of sections in laminar alignment connected to said sections at points along said bound edges of said sections.

2. The apparatus of claim 1 wherein said sheets are made of paper.

3. The apparatus of claim 1 wherein said hole conforms to the dimensions of said mirror.

4. The apparatus of claim 3 wherein said hole is rectangular.

5. The apparatus of claim 3 wherein said mirror may be any flat device imparting a reflection.

6. The cover of claim 1, further comprising:

(a) front and back flat planar members of equal size, each having first and second lateral edges and first and second end edges;

(b) a third flat planar member having first and second lateral edges and first and second end edges, wherein the length of said lateral edges of said third member correspond in length to the said lateral edges of said front and back members, and wherein the length of said end edges of said third member corresponds to the thickness of said series of sections in laminar alignment, whereby said third member forms a spine, said spine connected at points along said lateral edges of said spine to said front and back members at points along said first lateral edges of said front and back members by means for hinging, whereby said front planar member is connected to said first lateral edge of said spine and said back planar member is connected to said second lateral edge of said spine, and whereby a cover is provided which forms a front planar member connected to the spine and a back planar member connected to the spine, and the spine which is connected to the bound edges of said sections.

7. The apparatus of claim 6 wherein said planar members are inflexible.

8. The apparatus of claim 6 wherein the planar members are flexible.

9. A book in combination with a mirror, comprising:

(a) a stack of flat flexible planar members, wherein each planar member has first and second lateral edges and first and second end edges and wherein said first lateral edges of said planar members are connected by means for connecting, and wherein at least one of said flat, flexible planar members being thicker than the rest;

(b) a mirror embedded into said thick flexible planar member;

(c) a cover, wherein said cover includes two flat planar members of equal dimension joined together by a third flat planar member, whereby the third flat planar member forms the spine of said cover, whereby said cover provides a front, a spine and a back, said cover connected to said first lateral edges of said planar members at points along one face of said spine.

10. A book apparatus, comprising: (a) a book; (b) a mirror embedded within a hollowed leaf section of said book, whereby said mirror may be turned in a similar fashion to turning a page in a book.

* * * * *